United States Patent [19]

Quatieri, Jr. et al.

[11] Patent Number: 4,856,068

[45] Date of Patent: Aug. 8, 1989

[54] AUDIO PRE-PROCESSING METHODS AND APPARATUS

[75] Inventors: Thomas F. Quatieri, Jr., Arlington; Robert J. McAulay, Lexington, both of Mass.

[73] Assignee: Massachusetts Institute of Technology, Cambridge, Mass.

[21] Appl. No.: 34,204

[22] Filed: Apr. 2, 1987

Related U.S. Application Data

[63] Continuation-in-part of Ser. No. 712,866, Mar. 18, 1985.

[51] Int. Cl.[4] ..... G10L 5/00

[52] U.S. Cl. ..... 381/47; 381/106

[58] Field of Search ..... 381/51, 72, 106, 47

[56] References Cited

U.S. PATENT DOCUMENTS

| | | | |
|---|---|---|---|
| 3,360,610 | 12/1967 | Flanagan | 179/15.55 |
| 4,058,676 | 11/1977 | Wilkes et al. | 179/1 SA |
| 4,076,958 | 2/1978 | Fulghum | 179/1.5 A |
| 4,214,125 | 7/1980 | Mozer et al. | 381/51 |

OTHER PUBLICATIONS

"A Tone-Oriented Voice-Excited Vocoder", Hedlin; Chalmers University of Technology, Gothenburg, Sweden, CH1610/5/81, pp. 205-208.

"A Representation of Speech with Partials", Hedelin; 1982 Elmevier Biological Press, The Representation of Speech in the Paripheral Auditory System, R. Carlson & B. Granstrom, pp. 247-250.

"A Method of Pulse Compression Employing Nonlinear Frequency Modulation", Key et al., Massachusetts Institute of Technology Lincoln Laboratory, Technical Report No. 207, pp. 1-12.

Schroeder, *IEEE*, "Synthesis of Low-Peak-Factor Signals and Binary Sequences with Low Autocorrelation", vol. IT-16, pp. 85-89, 1970.

Technical Center of the European Broadcasting Union, "Modulation-Processing Techniques for Sound Broadcasting", vol. Tech. 3243-E, pp. 2-43, 1985.

Blesser, *IEEE*, "Audio Dynamic Range Compression for Minimum Perceived Distortion", vol. AU-17, No. 1, pp. 22-32, 1969.

McNally, *J. Audio Eng. Soc.*, "Dynamic Range Control of Digital Audio Signals", vol. 32, No. 5, pp. 316-327, 1984.

Fisk, *Ham Radio*, "Novel Audio Speech Processing Technique Offers Maximum Talk Power with Negligible Distortion", pp. 30-33, 1976.

Product Literature from the Orban Associates on the "Optimod-AM" Product.

Product Literature from Circuit Research Labs on the "AM-4" Audio Processing Systems.

*Primary Examiner*—Emanuel S. Kemeny

*Attorney, Agent, or Firm*—Thomas J. Engellenner

[57] ABSTRACT

A lower threshold for dynamic range compresssion and clipping is allowed by sinusoidal estimation and phase adjustment of the original speech signal to obtain a lower Peak to RMS ratio. A sinusoidal speech representation system is applied to the problem of speech dispersion by pre-processing the waveform prior to transmission to reduce the peak-to-RMS ratio of the waveform. The sinusoidal system first estimates and then removes the natural phase dispersion in the frequency components of the speech signal. Artificial dispersion based on pulse compression techniques is then introduced with little change in speech quality. The new phase dispersion allocation serves to preprocess the waveform prior to dynamic range compression and clipping, allowing considerably deeper thresholding than can be tolerated on the original waveform.

20 Claims, 2 Drawing Sheets

AUDIO PRE-PROCESSING METHODS AND APPARATUS

The U.S. Government has rights in this invention pursuant to an interagency agreement between the Air Force Systems Command and the U.S. Information Agency, Agreement No. MO 640-0053.

REFERENCE TO RELATED APPLICATION

This application is a continuation-in-part of U.S. Ser. No. 712,866 "Processing Of Acoustic Waveforms" filed Mar. 18, 1985 herein incorporated by reference.

BACKGROUND OF THE INVENTION

The technical field of this invention is speech transmission and, in particular, methods and devices for pre-processing audio signals prior to broadcast or other transmission.

The problem of speech degradation by natural or man-made disturbances is one which commonly occurs in AM radio broadcasting and ground-to-air communications. Often in these applications, a peak-power limitation is imposed by the transmitter or a dynamic range constraint results either from the sensitivity characteristics of the receiver or from the ambient noise level. Under these constraints, the audio signals are preprocessed to increase intelligibility. Techniques such as dynamic range compression, pre-emphasis and clipping have been applied with limited success to reduce the peak factor of a waveform in order to increase loudness while attempting to preserve important features of the spectral envelope. For a further description of such techniques, see *Modulation-Process Techniques for Sound Broadcasting,* Tech. 3243-E, Technical Center of the European Broadcasting Union, Bruxelles, Belgium, July 1985, herein incorporated by reference.

There exists a need for better preprocessing techniques for speech transmission, particularly where the spectral magnitude is specified and the goal is to achieve a flattened time-domain envelope which satisfies peak power limitations. In particular, new techniques for accomplishing automatic gain control, (multiband) dynamic range compression, pre-emphasis and phase dispersion would satisfy a long-felt need in the field.

The above-referenced parent application U.S. Ser. No. 712,866 discloses that speech analysis and synthesis as well as coding and time-scale modification can be accomplished simply and effectively by employing a time-frequency representation of the speech waveform which is independent of the speech state. Specifically, a sinusoidal model for the speech waveform is used to develop a new analysis-synthesis technique.

The basic method of U.S. Ser. No. 712,866 includes the steps of: (a) selecting frames (i.e. windows of about 20–40 milliseconds) of samples from the waveform; (b) analyzing each frame of samples to extract a set of frequency components; (c) tracking the components from one frame to the next; and (d) interpolating the values of the components from one frame to the next to obtain a parametric representation of the waveform. A synthetic waveform can then be constructed by generating a series of sine waves corresponding to the parametric representation. The disclosures of U.S. Ser. No. 712,866 are incorporated herein by reference.

In one illustrated embodiment described in detail in U.S. Ser. No. 712,866, the basic method summarized above is employed to choose amplitudes, frequencies, and phases corresponding to the largest peaks in a periodogram of the measured signal, independently of the speech state. In order to reconstruct the speech waveform, the amplitudes, frequencies, and phases of the sine waves estimated on one frame are matched and allowed to continuously evolve into the corresponding parameter set on the successive frame. Because the number of estimated peaks are not constant and slowly varying, the matching process is not straightforward. Rapidly varying regions of speech such as unvoiced/voiced transitions can result in large changes in both the location and number of peaks. To account for such rapid movements in spectral energy, the concept of "birth" and "death" of sinusoidal components is employed in a nearest-neighbor matching method based on the frequencies estimated on each frame. If a new peak appears, a "birth" is said to occur and a new track is initiated. If an old peak is not matched, a "death" is said to occur and the corresponding track is allowed to decay to zero. Once the parameters on successive frames have been matched, phase continuity of each sinusoidal component is ensured by unwrapping the phase. In one preferred embodiment the phase is unwrapped using a cubic phase interpolation function having parameter values that are chosen to satisfy the measured phase and frequency constraints at the frame boundaries while maintaining maximal smoothness over the frame duration. Finally, the corresponding sinusoidal amplitudes are simply interpolated in a linear manner across each frame.

SUMMARY OF THE INVENTION

A sinusoidal speech representation system is applied to the problem of speech dispersion by pre-processing the waveform prior to transmission to reduce the peak-to-RMS ratio of the waveform. The sinusoidal system first estimates and then removes the natural phase dispersion in the frequency components of the speech signal. Artificial dispersion based on pulse compression techniques is then introduced with little change in speech quality. The new phase dispersion allocation serves to preprocess the waveform prior to dynamic range compression and clipping, allowing considerably deeper thresholding than can be tolerated on the original waveform.

Whereas conventional systems accomplish phase dispersion using all-pass dispersion networks, it is shown that, using the sinsoidal system, the phases of the individual sine waves can be manipulated to achieve improvements in the peak-to-RMS ratio. For example, dispersion of the speech waveform can be performed by first removing the vocal tract system phase derived from the measured sine-wave amplitudes and phases, and then modifying the resulting phase of the sine waves which make up the speech vocal cord excitation.

The present invention also allows for (multiband) dynamic range compression, pre-emphasis and adaptive processing. A method of dynamic range control is described, which is based on scaling the sine-wave amplitudes in frequency (as a function of time) with appropriate attack and release-time dynamics applied to the frame energies. Since a uniform scaling factor can be applied across frequency, the short-time spectral shape is maintained. The phase dispersion solution can also be applied to determine parameters which drive dynamic range compression and, hence, the phase dispersion and dynamic range procedures can be closely coupled to each other. In addition, the sinusoidal system allows dynamic range control to be applied conveniently to separate frequency bands, utilizing different low- and high-frequency characteristics. Pre-emphasis, or any desired frequency shaping, can be performed simply by shaping the sine-wave amplitudes versus frequency prior to computing the phase dispersion. The phase dispersion techniques can take into account and yield optimal solutions for any given pre-emphasis approach.

The sinusoidal analysis/synthesis system is also particularly suitable for adaptive processing, since linear and non-linear adaptive control parameters can be derived from the sinusoidal parameters which are related to various features of speech. For example, one measure can be derived based on changes in the sinusoidal amplitudes and frequencies across an analysis frame duration and can be used in selectively accentuating frequency components and expanding the time scale.

The invention will next be described in connection with certain illustrated embodiments. However, it should be clear that various modifications, additions and subtractions can be made by those skilled in the art without departing from the spirit and scope of the invention.

DETAILED DESCRIPTION

Figure 1:
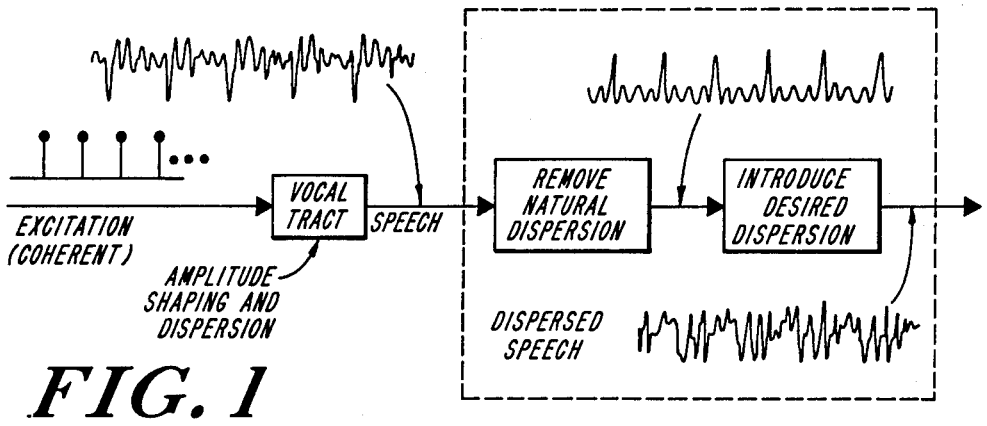
FIG. 1 is a flow diagram of a method for introducing an artificial phase dispersion according to the present invention.

In FIG. 1, a schematic approach according to the present invention is shown whereby the natural dispersion of speech is replaced by a desired dispersion which yields a pre-processed waveform suitable for dynamic range compression and clipping prior to broadcast or other transmission to improve range and/or intelligibility. The object of the present invention is to obtain a flattened, time-domain envelope which can satisfy peak power limitations and to obtain a speech waveform with a low peak-to-RMS ratio.

Figure 2:
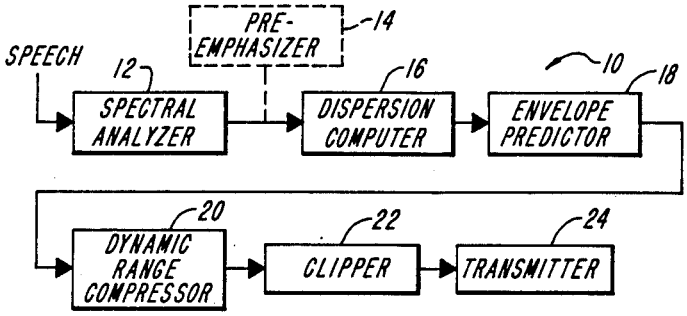
FIG. 2 is a general block diagram of an audio pre-processing system according to the present invention.

In FIG. 2, a block diagram of the audio preprocessing system 10 of the present invention is shown consisting of a spectral analyzer 12, pre-emphasizer 14, dispersion computer 16, envelope estimator 18, dynamic range compressor 20 and waveform clipper 22. The spectral analyzer 12 computes the spectral magnitude and phase of a speech frame. The magnitude of this frame can then be pre-emphasized by pre-emphasizer 14, as desired. The system (i.e., vocal tract) contributions are then used by the dispersion computer 16 to derive an optimal phase dispersion allocation. This allocation can then be used by the envelope estimator 18 to predict an time-domain envelope shape, which is used by the dynamic range compressor 20 to derive a gain which can be applied to the sine wave amplitudes to yield a compressed waveform. This waveform can be clipped by clipper 22 to obtain the desired waveform for broadcast by transmitter 24 or other transmission.

Figure 3:
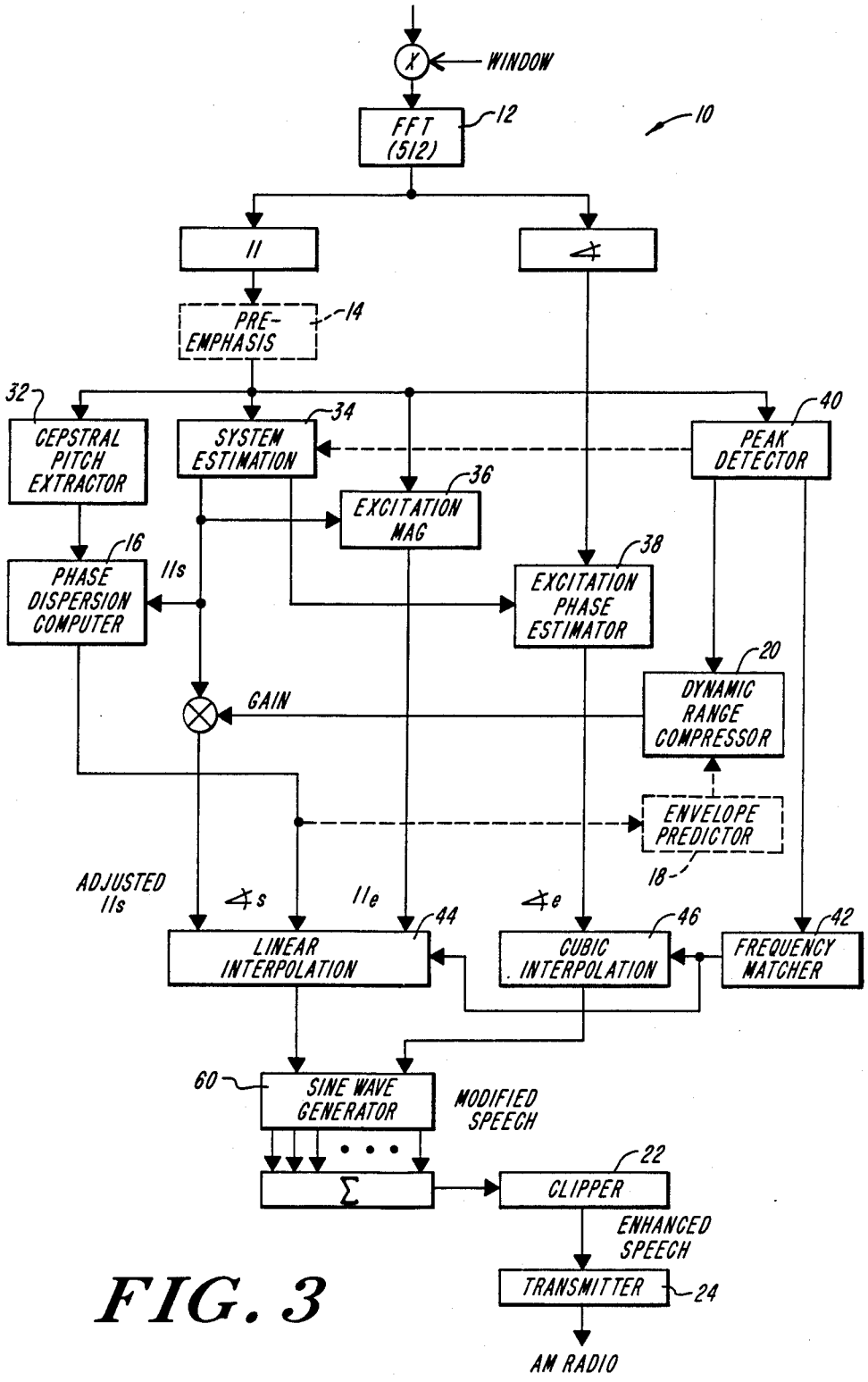
FIG. 3 is a more detailed illustration of the system of FIG. 2.

In FIG. 3, the system 10 for pre-processing speech is shown in more detail having a Fast Fourier Transformer (FFT) spectral analyzer 12, system magnitude and phase estimator 34, an excitation magnitude estimator 36 and an excitation phase estimator 38. Each of these components can be similar in design and function to the same identified elements shown and described in U.S. Ser. No. 712,866. Essentially, these components serve to extract representative sine waves defined to consist of system contributions (i.e., from the vocal tract) and excitation contributions (i.e., from the vocal chords). Similarly, a peak detector 40 and frequency matcher 42, along the same lines as those described in U.S. Ser. No. 712,766 are employed to track and match the individual frequency components from one frame to the next. A pre-emphasizer 14, also known in the art, can be interposed between the spectral analyzer 12 and the system estimator 34.

In a simple embodiment, the speech waveform can be digitized at a 10 kHz sampling rate, low-passed filtered at 5 kHz, and analyzed at 10 msec frame intervals with a 25 msec Hamming window. Speech representations, according to the invention, can also be obtained by employing an analysis window of variable duration. For some applications, it is preferable to have the width of the analysis window be pitch adaptive, being set, for example, at 2.5 times the average pitch period with a minimum width of 20 msec.

To achieve continuity at the frame boundaries, the magnitude and phase values must be interpolated from frame to frame. The system magnitude and phase values, as well as the excitation magnitude values, can be interpolated by linear interpolator 44, while the excitation phase values are preferably interpolated by cubic interpolator 46. Again, this technique is described in more detail in parent case, U.S. Ser. No. 712,866, herein incorporated by reference.

The illustrated system employs a pitch extractor 32. Pitch measurements can be obtained in a variety of ways. For example, the Fourier transform of the logarithm of the high-resolution magnitude can first be computed to obtain the "cepstrum". A peak is then selected from the cepstrum within the expected pitch period range. The resulting pitch determination is employed by the phase dispersion computer 16 (as described below) and can also be used by the system estimator 34 in deriving the system magnitudes.

In the system estimator 34, a refined estimate of the spectral envelope can be obtained by linearly interpolating across a subset of peaks in the spectrum (obtained from peak detector 40) based on pitch determinations (from pitch extractor 32). The system estimator 34 then yields an estimate of the vocal tract spectral envelope. For further details, again, see U.S. Ser. No. 712,866.

In the present invention, the excitation phase estimator 38 is employed to generate an excitation phase estimate. In one embodiment, using a Hilbert Transform with the system amplitude, an initial (minimum) phase estimate of the system phase is obtained. The minimum phase estimate is then subtracted from the measured phase. If the minimum phase estimate were correct, the result would be the linear excitation phase. In general, however, there will be a phase residual randomly varying about the linear excitation phase. A best linear phase estimate using least squares techniques can then be computed. For a further discussion of excitation phase estimation, see a paper by the present inventors "Phase Modeling And Its Application To Sinusoidal Transform Coding" *Proceedings of ICASSP* 1986.

In estimating the excitation function, small errors in the linear estimate can be corrected using the system phase. The system phase estimate can be obtained by subtracting the linear phase from the measured phase and then used along with the system magnitude to generate a system impulse response estimate. This response can be cross-correlated with a response from the previous frame. The measured delay between the responses can be used to correct that linear excitation phase estimate. Other alignment procedures will be apparent to those skilled in the art.

Figure 4:
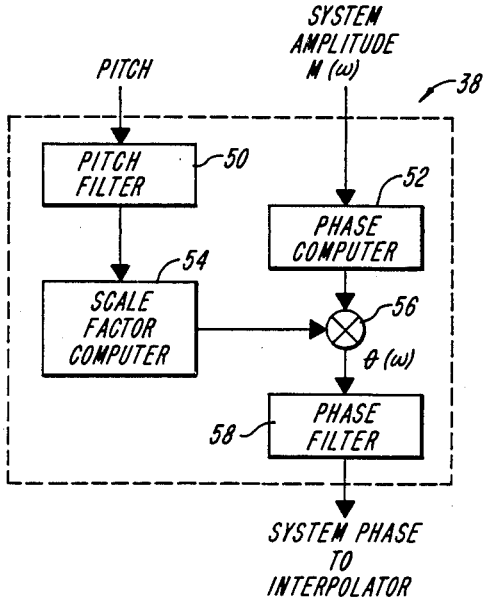
FIG. 4 is a more detailed illustration of the phase dispersion computer of FIG. 3.

In the present invention, an artificial system phase is computed by phase dispersion computer 16 from the system magnitude and the pitch. The operation of phase dispersion computer 16 is shown in more detail in FIG. 4, where the raw pitch estimate from the cepstral pitch extractor 32 is smoothed (i.e. by averaging with a first order recursive filter 50) and a phase estimate is obtained by phase computer 52 from the system magnitude by the following equation:

$$\theta(\omega) = k \int_{o}^{\omega} g(\omega')d\omega' \tag{1A}$$

where, $$g(\omega') = \int_{o}^{\omega'} M^2(\alpha)d\alpha \tag{1B}$$

where $\theta(\omega)$ is the artificial system phase estimate and k is the scale factor and $M(\omega)$ is the system magnitude estimate. This computation can be implemented, for example, by using samples from the FFT analyzer 12 and performing numerical integration.

The scale factor k is obtained by the scale factor computer 54 by solving the following equation $$k = 2\pi(\text{pitch period})/g(\pi) \tag{2}$$

where g ($\pi$) is the value of EQ. (1B) at $\pi$. Multiplier 56 multiplies the phase computation by the scale factor to yield the system phase estimate $\theta(\omega)$ for phase dispersion, which can then be further smoothed along the frequency tracks of each sine wave (i.e., again using a 1st order recursive filter 58 along such frequency tracks). The system phase is then available for interpolation.

With reference again to FIG. 2, the system phase can also be used by envelope estimator 18 to estimate the time domain envelope shape. For example, the envelope can be computed by using a Hilbert transform to obtain an analytic signal representation of the artificial vocal tract response with the new phase dispersion. The magnitude of this signal is the desired envelope. The average envelope measure is then used by dynamic range compressor 20 to determine an appropriate gain. The envelope can also be obtained from the pitch period and the energy in the system response by exploiting the relationship of the signal and its Fourier transform. A desired output envelope is computed from the measured system envelope according to a dynamic range compression curve and appropriate attack and release times. The gain is then selected to meet the desired output envelope. The gain is applied to the system magnitudes prior to interpolation.

Alternatively, the dynamic range compressor 20 can determine a gain from the detected peaks by computing an energy measure from the sum of the squares of the peaks. Again, a desired output energy is computed from the measured sinewave energy according to a dynamic range compression curve and appropriate attack and release times. The gain is then selected to meet the desired output energy. The gain is applied to the sinewave magnitudes prior to interpolation.

After interpolation, sinewave generator 60 generates a modified speech waveform from the sinusoidal components. These components are then summed and clipped by clipper 22. The spectral information in the resulting dispersed waveform is embedded primarily within the zero crossings of the modified waveform, rather than the waveform shape. Consequently, this technique can serve as a pre-processor for waveform clipping, allowing considerably deeper thresholding (e.g., 40% of the waveform's maximum value) than can be tolerated on the original waveform.

We claim:

1. A method of pre-processing an acoustic waveform prior to transmission to reduce the peak-to-RMS ratio of the waveform, the method comprising:

a. sampling the waveform to obtain a series of discrete samples and constructing therefrom a series of frames, each frame spanning a plurality of samples;

b. analyzing each frame of samples to extract a set of variable frequency components having individual amplitudes and phases;

c. removing the natural phase dispersion from said variable frequency components and substituting therefor a desired phase dispersion;

d. tracking said components from one frame to a next frame; and e. interpolating the values of the components from the one frame to the next frame to obtain a parametric representation of the waveform whereby a synthetic waveform having a flattened time-domain envelope can be constructed by generating a set of sine waves corresponding to the interpolated values of the parametric representation.

2. The method of claim 1 wherein the step of analysing each frame to extract a set of frequency components having individual amplitudes, further includes applying a pre-emphasis to said amplitude.

3. The method of claim 2 wherein the pre-emphasis is applied to system contributions of said amplitudes but not applied to excitation contributions of said amplitudes.

4. The method of claim 1 wherein the step of removing the natural phase dispersion further includes analyzing the phase dispersion of the system contributions of said frequency components and substituting therefore an artificial phase dispersion derived from a pitch estimate and the amplitudes of said system contributions.

5. The method of claim 4 wherein the pitch estimate is obtained from a cepstral pitch extractor.

6. The method of claim 5 wherein the pitch estimates from the cepstral extractor are further smoothed by recursive filtering.

7. The method of claim 4 wherein the phase components of the artificial phase dispersion are further smoothed by recursive filtering.

8. The method of claim 1 wherein the step of analyzing each frame to extract a set of frequency components having individual amplitudes further includes applying a dynamic range compression gain factor to said amplitudes.

9. The method of claim 8 wherein the gain factor is derived from peak determinations of the amplitudes of the frequency components.

10. The method of claim 8 wherein the gain factor is derived from an envelope prediction based on the desired phase dispersion.

11. A device for pre-processing an acoustic waveform prior to transmission to reduce the peak-to-RMS ratio of the waveform, the device comprising:

a. sampling means for sampling the waveform to obtain a series of discrete samples and constructing therefrom a series of frames, each frame spanning a plurality of samples;

b. analyzing means for analyzing each frame of samples to extract a set of variable frequency components having individual amplitudes and phrases;

c. phase substitution means for removing the natural phase dispersion from said variable frequency components and for substituting therefor a desired phase dispersion d. tracking means for tracking said variable frequency components from one frame to a next frame; and e. interpolating means for interpolating the values of the components from the one frame to the next frame to obtain a parametric representation of the waveform whereby a synthetic waveform having a flattened time-domain envelope can be constructed by generating a set of sine waves corresponding to the interpolated values of the parametric representation.

12. The device of claim 1 wherein the analyzing means further includes a pre-emphasizer for applying a pre-emphasis to said amplitude.

13. The device of claim 12 wherein the pre-emphasizer modifies the system contributions of said amplitudes but not the excitation contributions of said amplitudes.

14. The device of claim 11 wherein the phase dispersion computing means further includes means for determining a optimal phase dispersion from a pitch estimate and the amplitudes of said system contributions.

15. The device of claim 14 wherein the phase dispersion computing means further includes a cepstral pitch extractor.

16. The device of claim 15 wherein the phase dispersion computing means further includes a recursive pitch filter means for smoothing the pitch estimates from the cepstral extractor.

17. The device of claim 14 wherein the phase dispersion computing means further includes a recursive phase filter means for smoothing the phase dispersion computations.

18. The device of claim 11 wherein the analyzing means further includes a dynamic range compressor for applying a gain factor to said amplitudes.

19. The device of claim 18 wherein the dynamic range compressor further includes an envelope prediction means for predicting the time-domain envelope shape based on said artificial phase dispersion.

20. The device of claim 11 wherein the tracking means further includes a peak detector and a matching means for matching a frequency component from one frame with a component in the next frame having a similar value, the peak detector also providing peak determinations to a dynamic range compressor to derive a gain factor for application to said amplitudes.

* * * * *